US009297059B2

(12) United States Patent
Tetyukhin et al.

(10) Patent No.: US 9,297,059 B2
(45) Date of Patent: Mar. 29, 2016

(54) METHOD FOR THE MANUFACTURE OF WROUGHT ARTICLES OF NEAR-BETA TITANIUM ALLOYS

(75) Inventors: Vladislav Valentinovich Tetyukhin, Moscow (RU); Igor Vasilievich Levin, Verkhnaya Salda/Sverdlovskaya obl. (RU); Natalva Igorevna Levina, legal representative, Verkhnaya Salda Sverdlovskaya obl. (RU)

(73) Assignee: Public Stock Company, "VSMPO-AVISMA Corporation", Verkhnyaya Salda (RU)

( * ) Notice: Subject to any disclaimer, the term of this patent is extended or adjusted under 35 U.S.C. 154(b) by 456 days.

(21) Appl. No.: 13/876,017

(22) PCT Filed: Sep. 23, 2011

(86) PCT No.: PCT/RU2011/000730

§ 371 (c)(1), (2), (4) Date: May 31, 2013

(87) PCT Pub. No.: WO2012/044204

PCT Pub. Date: Apr. 5, 2012

(65) Prior Publication Data

US 2013/0233455 A1 Sep. 12, 2013

(30) Foreign Application Priority Data

Sep. 27, 2010 (RU) ..... 2010139738

(51) Int. Cl.
*C22F 1/18* (2006.01)
*C22C 14/00* (2006.01)

(52) U.S. Cl.
CPC ..... *C22F 1/183* (2013.01); *C22C 14/00* (2013.01); *C22F 1/18* (2013.01)

(58) Field of Classification Search
CPC ..... C22F 1/183; C22C 14/00
See application file for complete search history.

(56) References Cited

U.S. PATENT DOCUMENTS

2010/0180991 A1 7/2010 Heritier et al.

FOREIGN PATENT DOCUMENTS

| | | |
|---|---|---|
| CN | 101323939 | 12/2008 |
| CN | 101451206 | 6/2009 |
| CN | 101804441 | 8/2010 |
| JP | 63105954 | 5/1988 |
| JP | 11335803 | 12/1999 |
| RU | 2178014 | 1/2002 |
| RU | 2318074 | 2/2008 |

OTHER PUBLICATIONS

"International Preliminary Report on Patentability", for PCT/RU2011/000730 mailed Jan. 18, 2013 (3 pages).
"PCT International Search Report", from International Application No. PCT/RU2011/000730, mailed Dec. 28, 2011, (1 page).
"Written Opinion", for PCT/RU2011/000730, mailed Dec. 28, 2011 (3 pages).
"Decision to Grant", from RU Application No. 2010139738, mailed Aug. 17, 2011, 7 pages.
First Office Action, for Chinese Patent Application No. 201180046734.8 mailed Sep. 2, 2014 which corresponds to the present U.S. Appl. No. 13/876,017, 5 pages.

*Primary Examiner* — Jessee Roe
(74) *Attorney, Agent, or Firm* — Pauly, DeVries Smith & Deffner, L.L.C.

(57) ABSTRACT

This invention relates to nonferrous thermomechanical treatment of titanium alloys and can be used for manufacture of structural parts and components of high-strength near-beta titanium alloys for the aerospace application, mainly landing gear and airframe application. Multiple heating operations above or below beta transus temperature (BTT), hot working with the specified strain and cooling makes near-net shape forgings with stable properties having sections with thickness 100 mm and over and length over 6 m with the guaranteed level of mechanical properties, including ultimate tensile strength over 1200 MPa with fracture toughness, $K_{1C}$, not less than 35 MPa√m and fracture toughness, $K_{1C}$, over 70 MPa√m with ultimate tensile strength not less than 1100 MPa.

4 Claims, No Drawings

METHOD FOR THE MANUFACTURE OF WROUGHT ARTICLES OF NEAR-BETA TITANIUM ALLOYS

CROSS-REFERENCE TO RELATED APPLICATIONS

This application is a national stage application under 35 U.S.C. 371 of International Patent Application Serial No. PCT/RU2011/000730, entitled "METHOD FOR MANUFACTURING DEFORMED ARTICLES FROM PSEUDO-13-TITANIUM ALLOYS", filed Sep. 23, 2011, which claims the benefit of Russian Provisional Patent Application No. 2010139738 filed Sep. 27, 2010, the disclosures of which are incorporated herein by reference.

FIELD OF THE INVENTION

This invention relates to nonferrous metallurgy, namely to thermomechanical treatment of titanium alloys, and can be used for manufacture of structural parts and components of high-strength near-beta titanium alloys for the aerospace application, mainly landing gear and airframe application.

BACKGROUND

High specific strength of near-beta titanium alloys is very advantageous for their application in airframe structures. The major obstacle in building competitive passenger aircrafts is fabrication of structures and selection of materials with good balance of performance and weight. The need for these alloys has been determined by the current trends to increase the size and the weight of commercial aircrafts, which in its turn resulted in the increased section of high-loaded components, such as landing gear and airframe components, with the required uniform level of mechanical properties. In addition to that material requirements have become considerably stricter, i.e. a good combination of high strength and high fracture toughness has become a requirement. Such structures are made either of high-alloyed steels or titanium alloys. Substitution of titanium alloys for alloyed steels is potentially very advantageous, since it facilitates at least 1.5 times weight reduction, increase of corrosion resistance and reduced servicing. These titanium alloys give solution to this problem and can be used in production of a wide range of critical items, including large die forgings and forgings with section sizes over 150 to 200 mm and also semi-finished products having small sections, such as bar, plate with thickness up to 75 mm, which are widely used for fabrication of different aircraft components, including fasteners. Despite advantageous strength behavior of such titanium alloys as compared with steel, their application is limited by processing capability, i.e. by relatively high strain during hot working as a result of lower temperatures of hot working as compared with high-alloyed steels, low thermal conductivity and also difficulty to achieve uniform mechanical properties and structure, especially for heavy-section parts. Therefore, individual methods of processing are required to achieve the prescribed metal quality.

Near-beta titanium alloys Ti-5Al-5Mo-5V-3Cr—Zr are characterized by certain advantages when compared with other titanium alloys, e.g. with Ti-10V-2Fe-3Al. They are less susceptible to segregation, show strength behavior up to 10% higher than that of Ti-10V-2Fe-3Al alloy, have improved hardenability, which enables production of forgings with section sizes exceeding 200 mm (almost twice as high) with the uniform structure and properties, they are also characterized by improved processability. Moreover, alloys of this class demonstrate fracture toughness comparable to that of Ti-6Al-4V alloy with the strength over 1100 MPa, at that strength is 150-200 MPa higher than that of Ti-6Al-4V alloy. These alloys meet the requirements placed to the state-of-the-art aircrafts. For example, one of the advanced aircrafts uses forgings made of the alloy of this class, which weight varies between 23 kg (50 pounds) and 2600 kg (5700 pounds), and length—between 400 mm (16 inches) and 5700 mm (225 inches). A key factor governing the quality of these items is their thermomechanical treatment. The known methods are not capable of yielding the required stable mechanical properties.

There is a known method for processing of titanium alloy billets comprising ingot hot working via its upsetting and drawing at beta phase field temperatures with the strain of 50-60%, billet forging at $\alpha+\beta$ phase field temperatures with the strain of 50-60% and billet final hot working at $\beta$ phase field temperatures with the strain of 50-60% with subsequent annealing of a forging at a temperature that is 20 to 60° C. above beta transus temperature (hereinafter BTT) and soaking for 20-40 minutes (USSR Inventor's Certificate No. 1487274, IPC B2IJ5/00, published 10.06.1999).

The known method is characterized by high possibility of underfilling of high and thin ribs of complex-shaped die forgings and high localization of deformation during single hot working of billet at $\beta$ phase field temperatures with the strain of 50-60%. In addition to that when final hot working of billet is done in $\beta$ phase field via several heating operations, this inevitably results in considerable growth of grain due to secondary recrystallization, which leads to deterioration of mechanical behavior.

There is a known method of manufacture of bars of near-beta titanium alloys for fastener application, which includes billet heating to the temperature above beta transus in $\beta$ phase field, rolling at this temperature, cooling down to the ambient temperature, heating of rolled stock to a temperature that is 20-50° C. below beta transus temperature in $\alpha+\beta$ phase field and final rolling at this temperature (RF Patent No. 2178014, IPC C22F1/18, B21B3/00, published 10.02.2002)—prototype.

A drawback of the known method is its application for rolling of relatively small sections, for which final hot working at (BTT-20) to (BTT-50)° C. is sufficient to achieve the required level of microstructure, and, therefore, the required level of mechanical properties. However, speaking of complex-shaped items with large section sizes (thickness over 101 mm) and large overall dimensions, final hot working with the specified strain in $\alpha+\beta$ phase field is not enough to obtain homogeneous microstructure and uniform mechanical properties. Moreover, the specified parameters of thermomechanical treatment are not optimized for the manufacture of large die forgings.

SUMMARY OF THE INVENTION

Disclosed herein is a manufacturing method for wrought articles of near-beta titanium alloys including ingot melting and its thermomechanical processing via multiple heating, forging and cooling operations. The melted ingot consists of, in weight percentages, 4.0 to 6.0 aluminum, 4.5 to 6.0 vanadium, 4.5 to 6.0 molybdenum, 2.0 to 3.6 chromium, 0.2 to 0.5 iron, 2.0 max. zirconium, 0.2 max. oxygen, 0.05 max. nitrogen. In addition to that, thermomechanical processing includes heating to a temperature that is 150 to 380° C. above BTT and hot working with the strain of 40 to 70%, heating to a temperature that is 60 to 220° C. above BTT and hot working with the strain of 30 to 60%, heating to a temperature that is 20 to 60° C. below BTT and hot working with the strain of 30 to 60%, with subsequent recrystallization via metal heating to a temperature that is 70 to 140° C. above BTT and hot working with the strain of 20 to 60% followed by cooling down to the ambient temperature, then heating to a temperature that is 20 to 60° C. below BTT and hot working with the strain of 30 to 70% and additional recrystallization via metal heating to a temperature that is 30 to 110° C. above BTT and hot working with the strain of 15 to 50% followed by cooling down to the ambient temperature, then heating to a temperature that is 20 to 60° C. below BTT and hot working with the strain of 50 to 90% and subsequent final hot working. In some embodiments, the final hot working is done after heating to a temperature that is 10 to 50° C. below BTT with the strain of 20 to 40% to ensure ultimate tensile strength over 1200 MPa and fracture toughness, $\kappa_{1C}$, of at least 35 MPa√m. In some embodiments, the final hot working is done after heating to a temperature that is 40 to 100° C. above BTT with the strain of 10 to 40% to ensure fracture toughness, $\kappa_{1C}$, over 70 MPa√m and ultimate tensile strength of at least 1100 MPa. In some embodiments an additional hot working of complex-shaped items is done with the strain of 15% max. after heating to a temperature that is 20 to 60° C. below BTT. This additional hot working is done after final hot working.

DETAILED DESCRIPTION

The object of this invention is controlled manufacture of articles made of near-beta titanium alloys and having homogeneous structure together with the uniform and high level of strength and high fracture toughness.

A technical result of this method is manufacture of near-net shape forgings with stable properties having sections with thickness 100 mm and over and length over 6 m with the guaranteed level of the following mechanical properties:

1. Ultimate tensile strength over 1200 MPa with fracture toughness, $\kappa_{1C}$, not less than 35 MPa√m.
2. Fracture toughness, $\kappa_{1C}$, over 70 MPa√m with ultimate tensile strength not less than 1100 MPa.

The set objective is achieved with the help of a manufacturing method for wrought articles of near-beta titanium alloys, which consists of the ingot melting and its thermomechanical processing via multiple heating, hot working and cooling operations. The melted ingot contains, in weight percentages, 4.0 to 6.0 aluminum, 4.5 to 6.0 vanadium, 4.5 to 6.0 molybdenum, 2.0 to 3.6 chromium, 0.2 to 0.5 iron, 2.0 max. zirconium, 0.2 max. oxygen and 0.05 max. nitrogen. Thermomechanical processing includes heating to a temperature that is 150° C. to 380° C. above BTT and hot working with the strain of 40% to 70%, heating to a temperature that is 60° C. to 220° C. above BTT and hot working with the strain of 30% to 60%, heating to a temperature that is 20° C. to 60° C. below BTT and hot working with the strain of 30% to 60% with subsequent recrystallization treatment via heating to a temperature that is 70° C. to 140° C. above BTT followed by hot working with the strain of 20% to 60% and cooling down to the ambient temperature, heating to a temperature that is 20° C. to 60° C. below BTT, hot working with the strain of 30% to 70% and additional recrystallization processing via heating to a temperature that is 30° C. to 110° C. above BTT and subsequent hot working with the strain of 15% to 50% followed by cooling down to the ambient temperature, then heating to a temperature that is 20° C. to 60° C. below BTT with hot working with the strain of 50% to 90% and subsequent final hot working.

Final hot working after heating to a temperature that is 10° C. to 50° C. below BTT is done with the strain of 20 to 40% to ensure ultimate tensile strength above 1200 MPa and fracture toughness, $\kappa_{1C}$, not less than 35 MPa√m. In order to ensure fracture toughness, $\kappa_{1C}$, above 70 MPa√m and ultimate tensile strength not less than 1100 MPa, final hot working is done with the strain of 10% to 40% after heating to a temperature that is 40° C. to 100° C. above BTT. Final hot working of complex-shaped die forgings is followed by additional hot working with the strain not exceeding 15% after heating to a temperature that is 20° C. to 60° C. below BTT.

In order to produce near-net-shape die forgings with the ultimate tensile strength of at least 1100 MPa and fracture toughness, $\kappa_{1C}$, not less than 70 MPa√m, it is proposed to widely use die forging of this alloy in β phase field, in which strain resistance decreases as compared with hot working in α+β phase field, which provides potential capability of producing near-net-shaped die forgings with high metal utilization factor (MUF) thanks to the shape formed at the previous stage of hot working, which is near to the shape of the final article, with the strain of hot working being 10% to 40%.

The provided manufacturing method includes first hot working after ingot heating to a temperature that is 150° C. to 380° C. above BTT with the strain of 40% to 70%, which helps to break the as-cast structure, blend the alloy chemistry, consolidate the billet thus eliminating defects of melting origin such as cavities, voids, etc. Heating temperature below the specified limit leads to deterioration of plastic behavior, making hot working difficult and promoting surface cracking. Heating temperature above the specified limit results in considerable increase of gas saturation, which leads to surface tears during hot working, deterioration of the metal surface quality and as a result increased removal of the surface layer. Subsequent hot working with the strain of 30% to 60% following heating to a temperature that is 60° C. to 220° C. above BTT, helps to break a grain size a little as compared with the as-cast grain and improve metal ductility, so as to yield no defects during subsequent hot working in α+β phase field. Subsequent hot working with the strain of 30% to 60% after metal heating to a temperature that is 20° C. to 60° C. below BTT, breaks large-angle grain boundaries, increases concentration of dislocations, i.e. facilitates work hardening. Metal is characterized by the increased intrinsic energy and subsequent heating to a temperature that is 70° C. to 140° C. above BTT with hot working with the strain of 20% to 60% is followed by recrystallization with grain refining. The required grain size is not achieved at this stage of the process due to large sections of the intermediate stock, therefore work hardening is repeated with the strain of 30% to 70% after heating to a temperature that is 20° C. to 60° C. below BTT. After that recrystallization is also repeated. Additional recrystallization via heating to a temperature that is 30° C. to 110° C. above beta transus temperature and hot working with the strain of 15% to 50% followed by cooling down to the ambient temperature leads to formation of equiaxed macrograin in a workpiece with the size not exceeding 3000 μm. Further hot working with the strain of 50% to 90% after heating to a temperature that is 20° C. to 60° C. below beta transus temperature is done to produce homogeneous fine-grained globular microstructure.

The provided invention describes final hot working, which is done based on the required combination of facture toughness and ultimate tensile strength. To obtain ultimate tensile strength over 1200 MPa with fracture toughness, $\kappa_{1C}$, of at least 35 MPa√m, final hot working is done with the strain of 20% to 40% after heating to a temperature that is 10° C. to 50° C. below beta transus temperature, which produces equiaxed fine globular-lamellar structure along the whole section of a workpiece, which supports high level of strength with the acceptable values of fracture toughness, $\kappa_{1C}$. Heating temperature range during final hot working promotes refining and coagulation of primary a phase. To obtain fracture toughness, $\kappa_{1C}$, over 70 MPa√m with ultimate tensile strength of at least 1100 MPa, final hot working is done with the strain of 10% to 40% after heating to a temperature that is 40° C. to 100° C. above beta transus temperature. Such final hot working produces homogeneous lamellar structure along the section of a workpiece, which supports high values of $\kappa_{1C}$ with the acceptable level of strength.

In case of undesirable post-hot-working effects in complex-shaped items, such as lack of profile, underfilling of die impression, etc., it is expedient to introduce additional hot working in α+β phase field with the strain not exceeding 15% after heating to temperatures (BTT-20° C.) to (BTT-60° C.), which helps to obtain the required product shape and preserve the prescribed metal quality.

Experimental Section

Industrial applicability of the provided invention is proved by the following exemplary embodiment.

740 mm diameter ingots with the following average chemical composition (see Table 1) were melted to test the method.

TABLE 1

| Ingot | Content of elements, % wt. | | | | | | | |
|---|---|---|---|---|---|---|---|---|
| number | Al | V | Mo | Cr | Fe | Zr | O | N |
| 1 | 4.88 | 5.18 | 5.18 | 2.85 | 0.36 | 0.52 | 0.158 | 0.01 |
| 2 | 4.82 | 5.21 | 5.11 | 2.83 | 0.42 | 0.003 | 0.139 | 0.01 |
| 3 | 5.08 | 5.26 | 5.25 | 2.84 | 0.39 | 0.012 | 0.151 | 0.007 |

Complex-shaped die forgings were made of these ingots using different parameters of thermomechanical processing.

Ingot No. 1 was heated to a temperature that is 330° C. above BTT and all-round forged with the strain of 65%. After that metal was heated to a temperature that is 200° C. above BTT and hot worked with the strain of 58% and then after heating to a temperature that is 30° C. below BTT forged with the strain of 55%. Then material was recrystallized by heating to a temperature that is 120° C. above BTT and subsequent hot working with the strain of 25%. Then material was repeatedly work-hardened after heating to a temperature that is 30° C. below BTT and hot working with the strain of 40% and additionally recrystallized after metal heating to a temperature that is 100° C. above BTT and hot working with the strain of 15%. Further on, after heating to a temperature that is 30° C. below BTT, billet was subjected to forging, forging in shaped dies and preforming after heating to a temperature that is 50° below BTT, the resultant degree of hot working was 75% to 85% in different sections of a billet. To meet the requirement for ultimate tensile strength of 1200 MPa and facture toughness exceeding 35 MPa√m, metal was heated to a temperature that is 30° C. below BTT and forged in a finish die with the strain of 20% to 30% in different sections of a forged part. The part was tested (see Table 2) after heat treatment with the known parameters (solution heat treatment and aging). Mechanical properties of a similar part made of Ti-10V-2Fe-3Al alloy via a known manufacturing method are given in Table 2 for reference.

Ingot No. 2 was heated to a temperature that is 300° C. above BTT and all-round forged with the strain of 62%. After that metal was heated to a temperature that is 220° C. above BTT and hot worked with the strain of 36%, and then after heating to a temperature that is 30° C. below BTT forged with the strain of 30%. After that material was recrystallized by heating to a temperature that is 120° C. above BTT and subsequent hot working with the strain of 20%. Then material was repeatedly work-hardened after heating to a temperature that is 30° C. below BTT and hot working with the strain of 56% and additionally recrystallized after metal heating to a temperature that is 80° C. above BTT and hot working with the strain of 25%. Further on, after heating to a temperature that is 30° C. below BTT, billet was subjected to forging, forging in shaped dies and preforming, the resultant degree of hot working was 58% to 70% in different sections of a forging. To meet the requirement for ultimate tensile strength of at least 1100 MPa and facture toughness exceeding 70 MPa√m, metal was heated to a temperature that is 80° C. above BTT and subjected to final hot working (final die forging) with the strain of 15% to 35% in different sections of a forged part. The part was tested (see Table 3) after heat treatment with the known parameters (solution heat treatment and aging).

Ingot No. 3 was heated to a temperature that is 250° C. above BTT and all-round forged with the strain of 45%. After that metal was heated to a temperature that is 190° C. above BTT and hot worked with the strain of 53% and then after heating to a temperature that is 30° C. below BTT forged with the strain of 56%. After that material was recrystallized by heating to a temperature that is 120° C. above BTT and subsequent hot working with the strain of 25%. Then material was repeatedly work-hardened after heating to a temperature that is 30° C. below BTT and hot working with the strain of 55% and additionally recrystallized after metal heating to a temperature that is 80° C. above BTT and hot working with the strain of 15%. Further on, after heating to a temperature that is 30° C. below BTT, billet was subjected to forging, forging in shaped dies and performing, then after heating to a temperature that is 30° below BTT, billet was forged in intermediate dies and the resultant degree of hot working was 70% to 80% in different sections of a forging. To meet the requirement for ultimate tensile strength of at least 1100 MPa and facture toughness exceeding 70 MPa√m, metal was heated to a temperature that is 80° C. above BTT and subjected to final hot working (final die forging) with the strain of 10% to 25% in different sections of a forged part. To prevent underfilling of die impression, metal was subjected to additional hot working with the strain of 5%-10% after heating to a temperature that is 30° C. below BTT. The part was tested (see Table 3) after heat treatment with the known parameters (solution heat treatment and aging).

Mechanical properties of a similar part made of Ti-6Al-4V alloy via a known manufacturing method are given in Table 3 for reference.

Therefore, the provided invention helps to control structure homogeneity and ensure the required level of mechanical properties in articles (especially large ones) made of high-strength near-beta titanium alloys consisting of (4.0 to 6.0)% Al-(4.5 to 6.0)% Mo-(4.5 to 6.0)% V-(2.0 to 3.6)% Cr-(0.2 to 0.5)% Fe-(2.0 max)% Zr.

TABLE 2

| Method | Yield strength, $\sigma_{0.2}$, MPa | Ultimate tensile strength, $\sigma_B$, MPa | Elongation, % | K1C, MPa√m |
|---|---|---|---|---|
| Provided, article | 1268 | 1311 | 10.2 | 43.1 |
| made of ingot | 1267 | 1310 | 11.0 | 45.7 |

TABLE 2-continued

| Method | Yield strength, $\sigma_{0.2}$, MPa | Ultimate tensile strength, $\sigma_B$, MPa | Elongation, % | K1C, MPa√m |
|---|---|---|---|---|
| No. 1 | | | | |
| Known, similar article made of Ti—10V—2Fe—3Al alloy | 1117<br>1143 | 1186<br>1192 | 10.6<br>9.8 | 50.7<br>52.5 |

TABLE 3

| Method | Yield strength, $\sigma_{0.2}$, MPa | Ultimate tensile strength, $\sigma_B$, MPa | Elongation, % | K1C, MPa√m |
|---|---|---|---|---|
| Provided, article made of ingot No. 2 | 1116<br>1102 | 1203<br>1187 | 9.4<br>7.2 | 83.7<br>85.7 |
| Provided, article made of ingot No. 3 | 1080<br>1066 | 1183<br>1166 | 9.2<br>7.6 | 103<br>101 |
| Known, similar article made of Ti—6Al—4V alloy | 900<br>901 | 974<br>979 | 9.5<br>9.7 | 93.8<br>95.4 |

The invention claimed is:

1. A manufacturing method for wrought articles of near-beta titanium alloys comprising ingot melting and thermomechanical processing wherein the melted ingot consists of, titanium and, in weight percentages, 4.0 to 6.0 aluminum, 4.5 to 6.0 vanadium, 4.5 to 6.0 molybdenum, 2.0 to 3.6 chromium, 0.2 to 0.5 iron, less than or equal to 2.0 zirconium, less than or equal to 0.2 oxygen, and less than or equal to 0.05 nitrogen, the method comprising heating to a temperature that is 150° C. to 380° C. above BTT and hot working at a strain of 40% to 70%; heating to a temperature that is 60° C. to 220° C. above BTT and hot working at a strain of 30% to 60%; heating to a temperature that is 20° C. to 60° C. below BTT and hot working at a strain of 30% to 60% with subsequent recrystallization via metal heating to a temperature that is 70° C. to 140° C. above BTT and hot working at a strain of 20% to 60%, cooling down to the ambient temperature, then heating to a temperature that is 20° C. to 60° C. below BTT and hot working with a strain of 30% to 70%; and additional recrystallization via metal heating to a temperature that is 30° C. to 110° C. above BTT and hot working with a strain of 15% to 50% followed by cooling down to ambient temperature, then heating to a temperature that is 20° C. to 60° C. below BTT and hot working with a strain of 50% to 90%; and subsequent final hot working.

2. The method of claim 1 wherein the final hot working is done after heating to a temperature that is 10° C. to 50° C. below BTT with a strain of 20% to 40% to result in ultimate tensile strength over 1200 MPa and fracture toughness, $K_{1C}$, of at least 35 MPa√m.

3. The method of claim 1 wherein the final hot working is done after heating to a temperature that is 40° C. to 100° C. above BTT with a strain of 10% to 40% to result in fracture toughness, $K_{1C}$, over 70 MPa√m and ultimate tensile strength of at least 1100 MPa.

4. The method of claim 1 further comprising an additional hot working with a strain of less than or equal to 15% after heating to a temperature that is 20° C. to 60° C. below BTT, wherein the additional hot working is done after the final hot working and wherein the wrought article is a forging made in a die.

* * * * *